US005897393A

United States Patent [19]

Haftmann

[11] Patent Number: 5,897,393

[45] **Date of Patent: *Apr. 27, 1999**

[54] PLUG-IN CONNECTOR ASSEMBLY FOR RIBBON CABLES

[76] Inventor: Johannes Haftmann, Schaftnacherweg 31, D-91126 Rednitzhembach, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/612,147

[22] Filed: Mar. 7, 1996

[30] Foreign Application Priority Data

Aug. 24, 1995 [DE] Germany ..... 195 31 208

[51] Int. Cl.[6] ..... H01R 9/07

[52] U.S. Cl. ..... 439/495; 439/328

[58] Field of Search ..... 439/327, 328, 439/495, 725, 67, 358

[56] References Cited

U.S. PATENT DOCUMENTS

| | | | |
|---|---|---|---|
| 4,188,086 | 2/1980 | Inouye et al. | 439/358 |
| 4,580,867 | 4/1986 | Wright et al. | 439/495 |
| 4,695,108 | 9/1987 | Ichitsubo | 439/327 |
| 4,969,840 | 11/1990 | Ii et al. | 439/495 |
| 5,104,338 | 4/1992 | Mitra | 439/495 |
| 5,160,275 | 11/1992 | Nakamura et al. | 439/328 |
| 5,414,220 | 5/1995 | Hanato et al. | 174/254 |

FOREIGN PATENT DOCUMENTS

| | | |
|---|---|---|
| 0 087 710 | 9/1983 | European Pat. Off. . |
| 54-157001 | 12/1979 | Japan . |
| 4206374 | 7/1992 | Japan . |
| 60-147188 | 9/1995 | Japan . |
| 2 272 583 | 5/1994 | United Kingdom . |

*Primary Examiner*—Hien Vu
*Attorney, Agent, or Firm*—Gary A. Samuels

[57] ABSTRACT

A plug-in connector assembly for ribbon cables comprises a ribbon cable, a plug-in connector, a locking spring and a locking spring housing. The locking spring may engage the ribbon cable in a shape-mated fashion to provide lateral guidance of the ribbon cable. The ribbon cable may be configured with a recess for spring-actuated engagement to provide strain relieving locking of the ribbon cable and to provide a region of electrical contact with the locking spring to enhance shielding contact.

10 Claims, 10 Drawing Sheets

PLUG-IN CONNECTOR ASSEMBLY FOR RIBBON CABLES

FIELD OF THE INVENTION

The present invention relates to the connection of ribbon cables to printed circuit boards. More particularly, the present invention relates to a plug-in connector assembly for ribbon cables.

BACKGROUND OF THE INVENTION

Ribbon cables often have a series of electrical conductors embedded next to each other in an insulation material. These conductors can be round with a circular cross section and/or flat with a rectangular cross section. Conventional plug-in connector housings have a cable plug-in opening to accept an end portion of a ribbon cable. Conductor contacts, in the form of conductor contact receptacles, electrically contact ribbon cable conductors when the cable is inserted into a plug-in connector housing. The conductor contacts are electrically connected to terminal contacts that can be electrically connected, for example, to the strip conductors of a printed circuit board.

In order to permit electrical contacting between the ribbon cable conductors and conductor contacts of the plug-in connector, the ribbon cable conductors are often exposed on one ribbon cable end, on a broad side of the ribbon cable, by stripping the insulation down to the ribbon cable conductors. However, the ribbon cable end loses its bending rigidity when the insulation on the ribbon cable end is stripped. A loss of rigidity hampers the inserting of the ribbon cable end into the cable plug-in opening of the plug-in connector and complicates problem-free electrical contacting between the exposed ribbon cable conductors and the conductor contacts.

To overcome this shortcoming, in the past a reinforcement layer, preferably in the form of a reinforcement sheet, has been applied on the broad side of the ribbon cable end on which the ribbon cable conductors are not exposed, i.e., no insulation has been removed. This has increased the bending rigidity of the ribbon cable end which was reduced by the stripping of the insulation. A material with a relatively high intrinsic bending rigidity has been used for the reinforcement sheet. Notwithstanding such an attempt to increase the rigidity of the stripped ribbon cable, this design suffers from shortcomings which detract from its usefulness.

A conventional ribbon cable has a sheet structure with a thickness of about 0.4 mm. The plug-in connectors commonly used for the connection of such a ribbon cable have a limited design height of about 10 mm. From the beginning of the cable plug-in opening, to the spring contacts of a conductor contact, a lateral guide for the thin ribbon cable exists only over a short zone of about 7 mm. Additionally, common plug-in connectors for connection of such ribbon cables have significant manufacturing tolerances. This means that the ribbon cable end must be plugged into the cable plug-in opening of the plug-in connector with only limited guide depth and unreliable lateral guiding. The ribbon cable end is likely to be plugged into the plug-in connector obliquely or with kinks. Misalignment of the ribbon cable with respect to the plug-in connector may cause the ribbon cable conductors to not properly contact corresponding conductor contacts.

In particular, such a problem arises in shielding flat conductor ribbon cables that have a shielding sheet situated above a layer of insulation material on each broad side of the cable, and in which a flat conductor situated on a longitudinal edge of the cable is in contact with both shielding sheets. The shielding sheets lie on this flat conductor without interposition of insulation material. Since insulation is lacking in this longitudinal edge region of the flat conductor ribbon cable, this longitudinal edge region is particularly labile.

The force with which the contact spring arms of the conductor contacts engage the ribbon cable conductors is limited given the very small size of the conductor contacts. Therefore, the ribbon cable conductors may loosen from the conductor contacts even if a small tensile force is exerted on the ribbon cable. However, such loosening is not acceptable in applications which demand a particularly high reliability of the plug-in connection between the ribbon cable end and the plug-in connector.

Additionally, ribbon cables often have an electrical shield in the form of a shielding sheet situated between an insulation material surrounding the ribbon cable conductors and an insulation material sheath of the ribbon cable. This shielding sheet needs to be electrically grounded. One way of providing this ground is by using an additional wire to connect the ribbon cable shield to either the plug-in connector shield or the ground conductor of a printed circuit board. Shielding quality, as is desired in high-grade applications, is not possible with this design.

The foregoing illustrates limitations known to exist in present plug-in connectors for ribbon cables. Thus, it is apparent that it would be advantageous to provide an improved plug-in connector directed to overcoming one or more of the limitations set forth above. Accordingly, a suitable alternative is provided including features more fully disclosed hereinafter.

SUMMARY OF THE INVENTION

The present invention advances the art of electrical connectors beyond which is known to date. In one embodiment of the present invention, a plug-in connector assembly for ribbon cables comprises a ribbon cable, a plug-in connector, a locking spring and a locking spring housing. The ribbon cable may be configured with a recess for spring-actuated engagement to provide strain relieving locking of the ribbon cable and to provide a region of electrical contact with the locking spring to enhance shielding contact. The locking spring may also engage the ribbon cable in a shape-mated fashion to provide lateral guidance of the cable.

The locking spring housing may also be designed to accept existing plug-in connectors by providing an opening in which an existing connector may be inserted and secured to the locking spring housing.

Additionally, the locking spring housing and the locking spring can form a single shield housing. The connector can be designed in one piece with this shielding housing, for example, by cutting and bending a section out from a side wall of the shielding housing.

In the present invention, the improved plug-in connector assembly provides an improved design height that provides improved contacting of the ribbon cable conductors with the conductor contacts of the plug-in connector, thereby preventing lateral pivoting and oblique insertion of the ribbon cable end. The housing also prevents inadvertent removal of the ribbon cable and produces reliable shield contacting with very low contact resistance.

Accordingly, it is a purpose of the present invention to provide an improved plug-in connector assembly for ribbon cables that prevents inadvertent removal of the ribbon cable from the plug-in connector.

It is another purpose of the present invention to provide an improved plug-in connector assembly for ribbon cables that provides improved contacting of the ribbon cable conductors with the conductor contacts of the plug-in connector.

It is another purpose of the present invention to provide an improved plug-in connector assembly for ribbon cables that prevents lateral pivoting and oblique insertion of the ribbon cable end.

It is another purpose of the present invention to provide an improved plug-in connector assembly for ribbon cables that produces reliable shield contacting with very low contact resistance.

BRIEF DESCRIPTION OF THE DRAWINGS

The foregoing summary, as well as the following detailed description of a preferred embodiment of the invention, will be better understood when read in conjunction with the appended drawings. For purposes of illustrating the invention, there is shown in the drawings an embodiment which is presently preferred. It should be understood, however, that the invention is not limited to the precise arrangement and instrumentality shown. In the drawings.

DETAILED DESCRIPTION OF THE INVENTION

Figure 1:
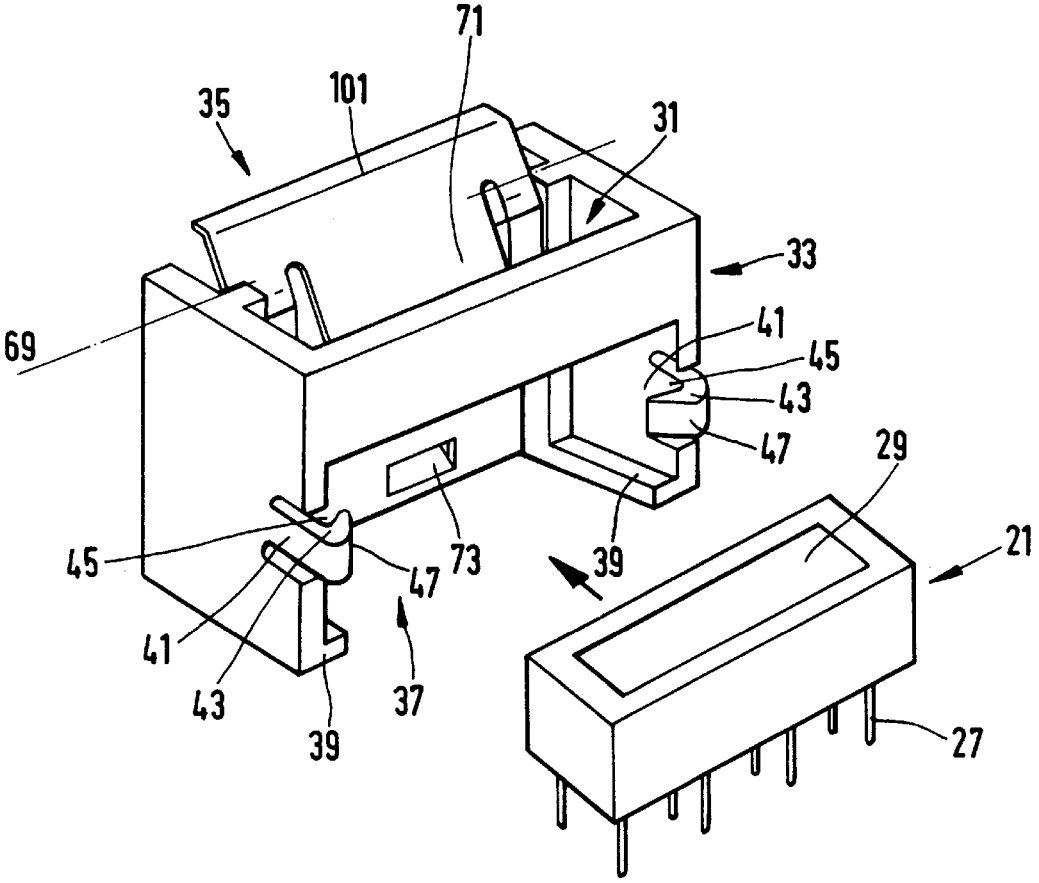
FIG. 1 shows a ribbon cable plug-in connector according to one embodiment of the present invention having a separate locking spring housing disposable about an ordinary plug-in connector.

Referring now to the drawings, wherein similar reference characters designate corresponding parts throughout the several views, the present invention is generally illustrated at 33 in the figures. The present invention generally comprises a ribbon cable, a plug-in connector, a locking spring and a locking spring housing.

Figure 13:
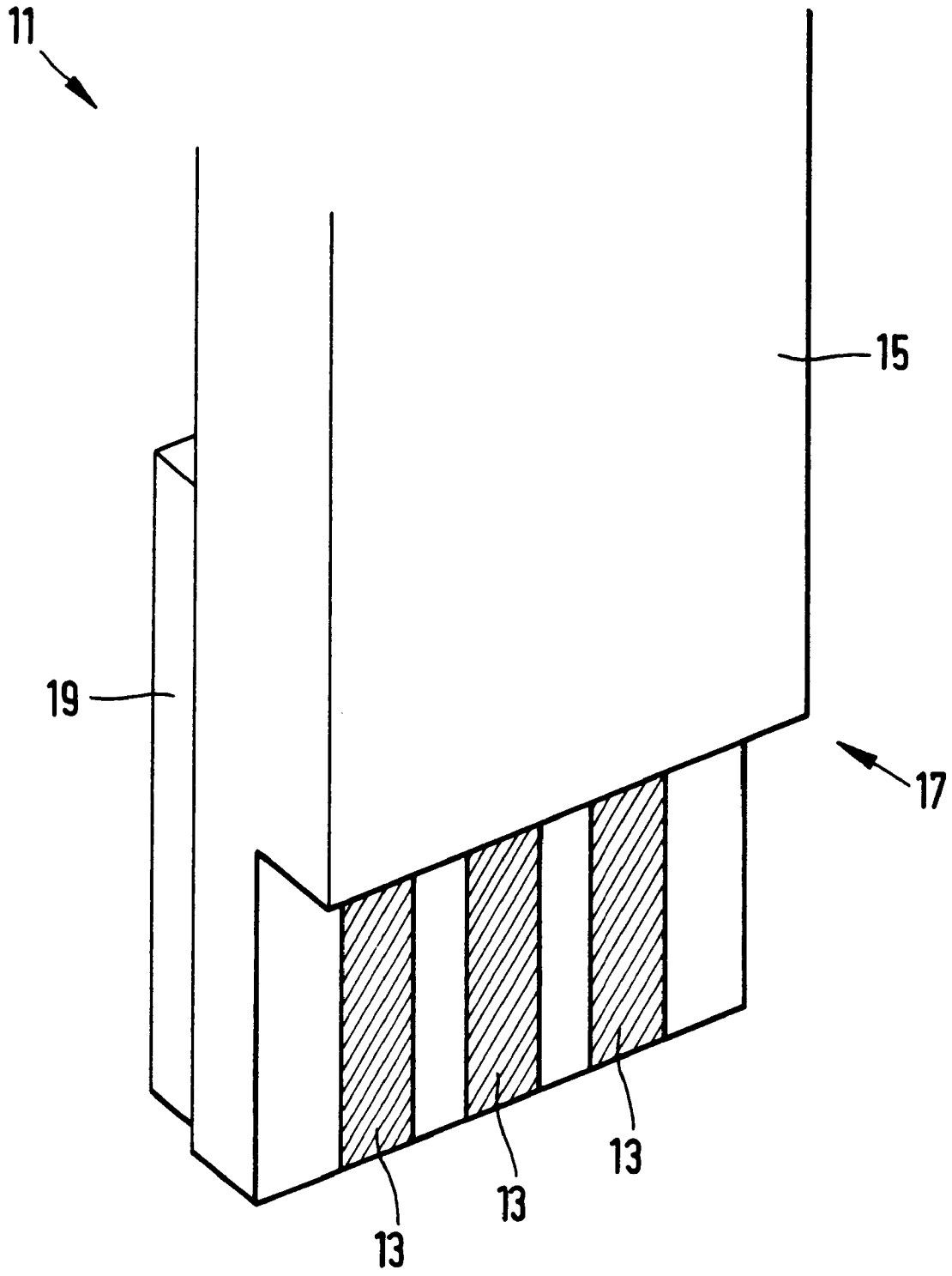
FIG. 13 shows a schematic representation of a ribbon cable end with flat connectors exposed on one side.

FIG. 13 shows a ribbon cable 11 in a schematic view with flat conductors 13 that are embedded on all sides in an insulation material 15. Ribbon cable 11 may have any number of flat conductors 13. Sheets of insulation material are applied on both sides of the flat conductors 13. Insulation material 15 can be expanded polytetrafluoroethylene (ePTFE), polyester or other plastics. Enough insulation material is removed in one end region 17 of the ribbon cable 11 to expose flat conductors 13 on one side to facilitate electrical contact. A reinforcement sheet 19, such as polyester, is applied to the insulation material 15 on the back of the ribbon cable end 17 on which the flat conductors 13 are still covered with insulation material 15. The reinforcement sheet 19 increases the bending rigidity of the ribbon cable end, which was reduced by exposure of flat conductors 13, and brings the ribbon cable end to the dimensions of the plug-in connector contacts. Without a reinforcement sheet 19, the ribbon cable end 17, which has a width of 15 mm and a thickness of 0.4 mm, for example, would become unstable due to removal of insulation 15 to expose flat conductors 13, and insertion thereof into the plug-in connector would be difficult.

Figure 14:
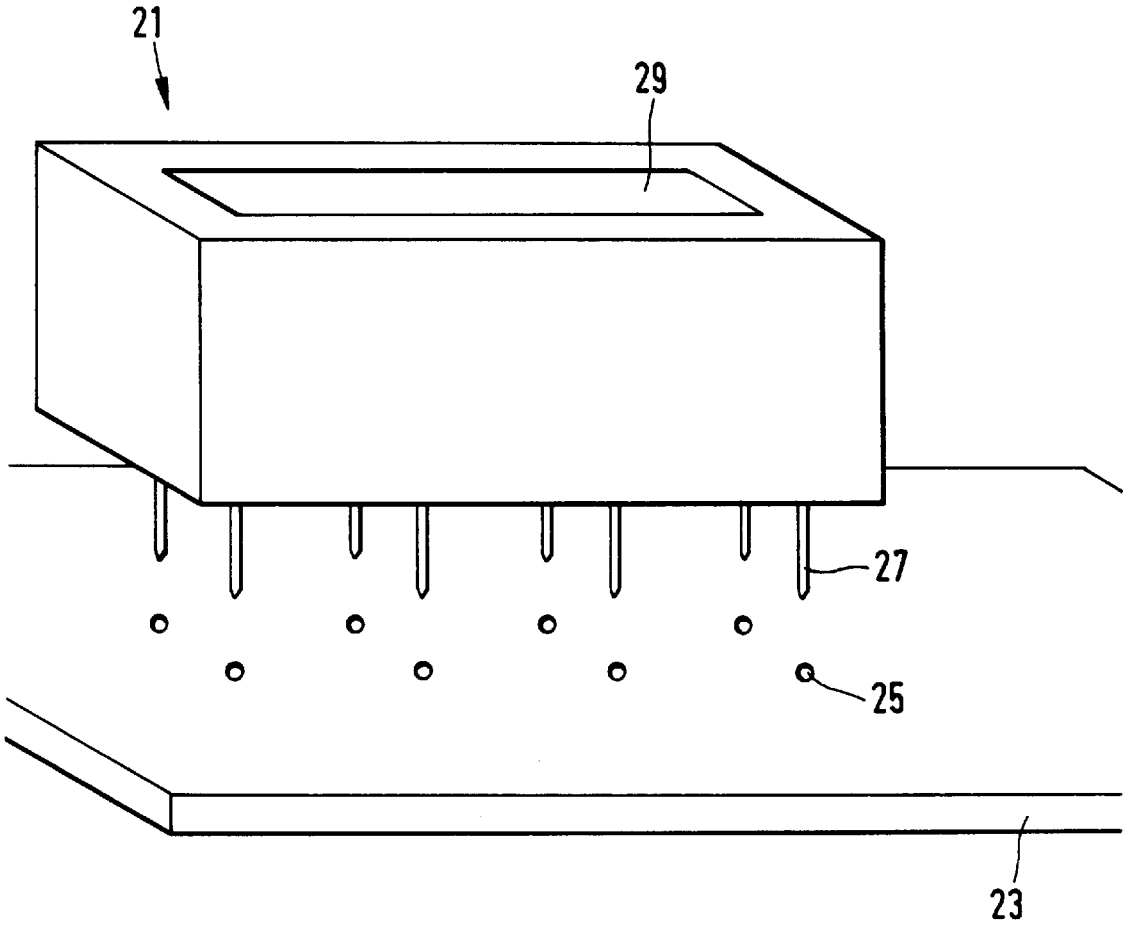
FIG. 14 shows a schematic view of an ordinary plug-in connector before insertion into the soldering holes of a printed circuit board.

FIG. 14 shows an ordinary plug-in connector 21 for acceptance of the ribbon cable end 17 and a printed circuit board 23 having soldering holes 25 for insertion and soldering of connection posts 27. The plug-in connector 21 is provided with a cable plug-in opening 29 on the side opposite the connection posts 27. The cable plug-in opening 29 is dimensioned so that ribbon cable end 17 can be inserted.

Conductor contacts of plug-in connector 21 (not visible in FIG. 14) extend into the cable plug-in opening 29, to electrically connect ribbon cable conductors 13 of the ribbon cable end 17 and strip conductors of printed circuit board 23.

A plug-in connection between a ribbon cable end 17 and a plug-in connector 21, according to FIG. 14, is known in the art but is replete with shortcomings which have detracted from its usefulness.

Such known plug-in connectors 21 have a design height of about 10 mm and an insertion depth of only about 6 mm. The ribbon cable end 17 is, therefore, guided during insertion into the cable plug-in opening 29 only over a very short length so that there is a considerable hazard that the ribbon cable end 17 will be inserted obliquely into the cable plug-in opening 29, which can lead to incorrect contacting between the flat conductors 13 and the conductor contacts (not shown) arranged in the plug-in connector 21.

FIG. 1 shows an embodiment of the present invention in which the ribbon cable end 17 is inserted into the cable plug-in opening 29 of an ordinary plug-in connector 21, not directly, but rather after passing through a cable plug-through opening 31 of an additional housing 33 forming a locking spring housing, in which a locking spring 35 is arranged. Use of the invention with plug-in connector 21 provides good lateral guidance of the ribbon cable end 17 during insertion, reliable attachment in the plug-in position and easy and reliable shield contacting of a ribbon cable shield.

If the ordinary plug-in connector 21 is not used, the plug-in connector housing and the locking spring housing can be designed as a one piece construction. The conductor contacts may be provided in the lower region of the plug-in connector and the locking spring in the upper region.

The additional housing 33 of FIG. 1 has a plug-in opening 37 on its lower end into which the plug-in connector 21 can be inserted. The plug-in opening 37 is open on the bottom to prevent collision with the connection posts 27 of the plug-in connector 21. Clamping ribs 39 extend laterally from the sidewalls of the lower end of plug-in opening 37. The side walls of plug-in opening 37 are each provided with a locking spring arm 41 cut out from a corresponding side wall. Each locking spring arm 41 has a locking hook 43 on its free end with a locking shoulder 45 and a leading slope 47. During insertion of plug-in connector 21 into plug-in opening 37, the locking spring arms 41 widen elastically when the plug-in connector 21 reaches the leading slope 47 if the plug-in connector 21 is pushed sufficiently deep into plug-in opening 37, the locking spring arms 41 spring back, whereupon their locking shoulders 45 snap behind plug-in connector 21 and secure it within plug-in opening 37.

The plug-in opening 37 and the locking spring arms 41 are dimensioned relative to the dimensions of the plug-in connector 21 so that when plug-in connector 21 is locked into plug-in opening 37, its cable plug-in opening 29 is aligned with the cable plug-through opening 31 of the additional housing 33. The ribbon cable end 17 can then be inserted through the cable plug-through opening 31 of additional housing 33 into the cable plug-in opening 29 of plug-in connector 21 guided by the cable plug-through opening 31. The additional housing 33 and locking spring 35 facilitate the alignment of the flat conductors 13 and the conductor contacts in plug-in connector 21, and prevent inadvertent withdrawal of the ribbon cable end 17 from the cable plug-in opening 29. The invention also provides correct alignment and prevention of withdrawal when an ordinary plug-in connector 21 is used.

The additional housing 33 may also be disposed about a plug-in connector 21 that has already been soldered to a printed circuit board by pushing it onto the soldered plug-in connector 21 and inserting the ribbon cable end 17 through the cable plug-through opening 31 and into the cable plug-in opening 29.

Figure 3:
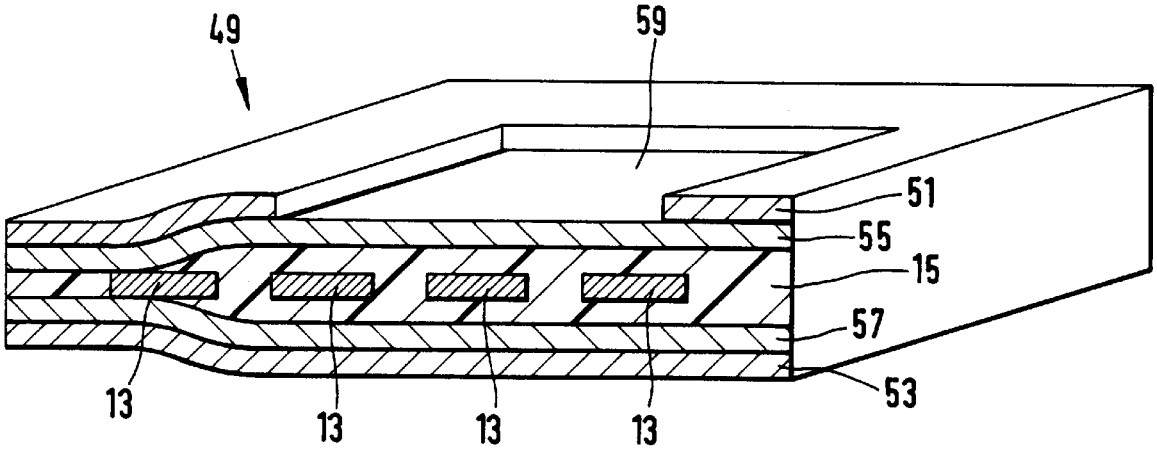
FIGS. 3–5 show cross sections of three different ribbon cable configurations along a line running across the longitudinal extent of the corresponding ribbon cable.
Figure 4:
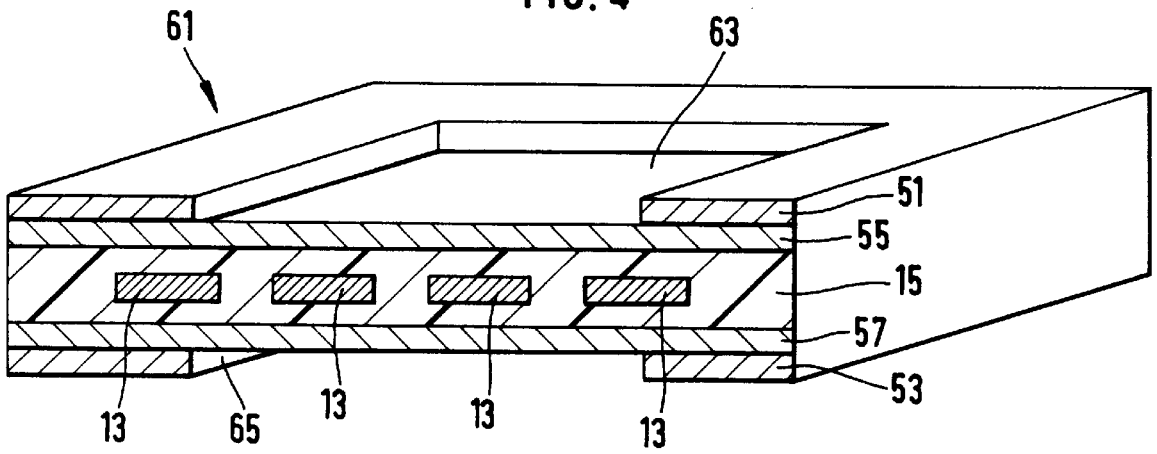
Figure 5:
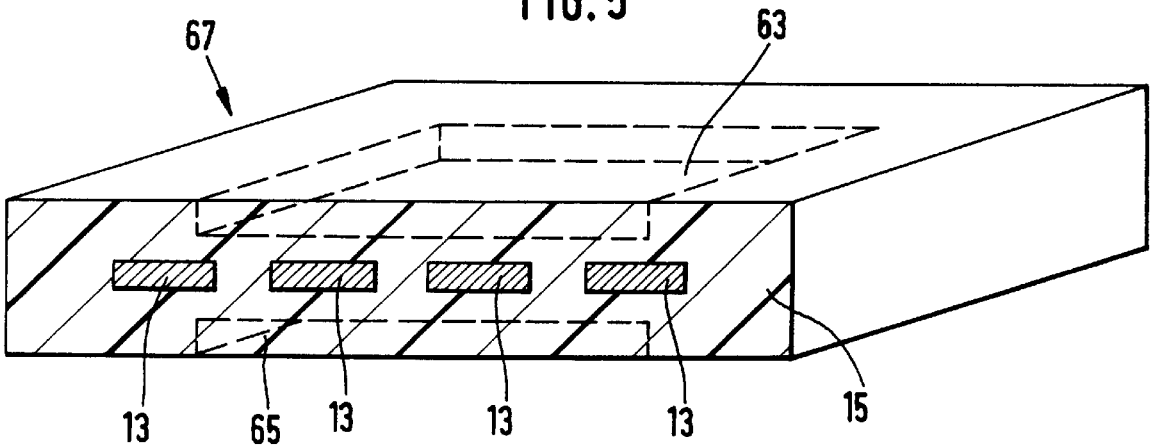

Three exemplary ribbon cable configurations, which are illustrated in FIGS. 3 to 5, are suitable for plug-in connection with the plug-in connector according to the present invention. FIGS. 3 and 4 show ribbon cable designs with shielding sheets, whereas FIG. 5 shows a ribbon cable design without a shielding sheet.

A first ribbon cable configuration 49, which is depicted in FIG. 3, contains four flat conductors 13 that are embedded in an insulation material 15. The upper longitudinal outside of the ribbon cable 49 is formed by an upper insulation sheath 51, and the lower longitudinal outside is formed by a lower insulation sheath 53. An upper shielding sheet 55 is situated in FIG. 3 between the insulation material 15 and the upper insulation sheath 51, and a lower shielding sheet 57 is situated between the insulation material 15 and the lower insulation sheath 53. The two shielding sheets 55 and 57 are separated from the three right most disposed flat conductors 13 by the insulation material 15, as seen in FIG. 3, while the two shielding sheets 55 and 57 contact the left most disposed flat conductor 13. Therefore its two shielding sheets 55 and 57 are electrically connected via the left flat conductor 13.

In one of the two insulation sheaths 51 and 53 (in the upper insulation sheath 51 in FIG. 3) a locking recess 59 is punched, in which the upper shielding sheet 55 is exposed.

A second ribbon cable configuration 61, which is depicted in FIG. 4, is substantially similar to the first ribbon cable configuration 49. In the second ribbon cable configuration 61, the two shielding sheets 55 and 57 are electrically insulated from all of the flat conductors 13 and from each other over their entire width. In order to be able to produce electrical contact to the two shielding sheets 55 and 57, a locking recess is situated in each of the two insulation sheaths 51 and 53, namely an upper locking recess 63 and a lower locking recess 65.

A third ribbon cable configuration 67, which is depicted in FIG. 5, shows an unshielded ribbon cable that has flat conductors 13 and an insulation material 15 disposed about the flat conductors. Since no shielding sheets are present, this ribbon cable configuration requires no locking recess. If a shape-mated locking is to be created between this ribbon cable configuration 67 and the locking spring device, an upper locking recess 63 and/or a lower locking recess 65, can be provided in the insulation material 15 of ribbon cable configuration 67.

In the embodiment depicted in FIG. 1, a locking spring 35 is arranged as a flat spring in the additional housing 33 that serves as locking spring housing. The locking spring 35 is mounted to pivot around a pivot axis 69 that runs parallel to the transverse direction of additional housing 33. The locking spring 35 has a roughly plate-like locking region 71 that extends obliquely downward in the direction of the plug-in opening 37 of the additional housing 33 from the region of the pivot axis 69. The locking spring 35 has a locking tab 73 cut from the plate-like body of locking spring 35 and bent out obliquely upward on the side of locking spring 35 facing away from the plug-in opening 37.

Figure 2:
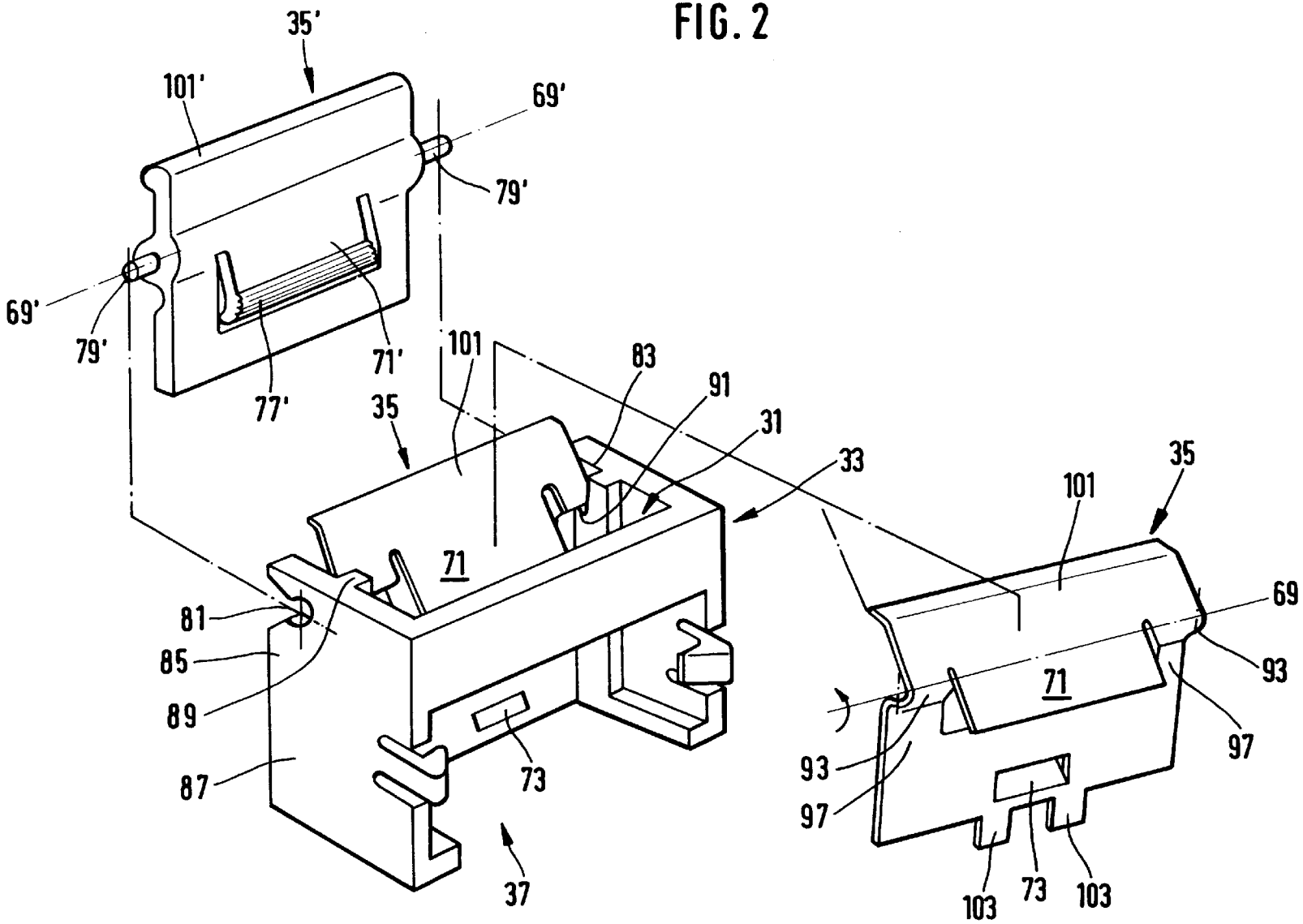
FIG. 2 shows a plug-in connector according to FIG. 1 with two alternatively applicable locking spring devices.

FIG. 2 shows a variant of the additional housing 33 in which either a locking spring 35 or a locking spring 35' can be arranged. The locking spring 35 corresponds to the locking spring depicted in FIG. 1 and is designed primarily for shape-mated engagement in a respective locking recess of one of the ribbon cable configurations 49, 61 or 67 depicted in FIGS. 3 to 5. The locking spring 35' is primarily designed for spring-actuated engagement of a ribbon cable which need not have any locking recess, like the ribbon cable configuration 67 depicted in FIG. 5. A locking region 71' of locking spring 35' is provided with blocking ribs 77' in order to improve spring-actuated engagement on the longitudinal outside of the ribbon cable. The locking spring 35' has pivot axis stubs 79' on its pivot axis 69' that can be locked into pivot axis holes 81 (open on one side) of the additional housing 33.

More particularly, if the locking spring 35 is used for electrical contacting of an exposed ribbon cable sheet shield 55 or 57, it consists of metal or an electrically conducting material in order to produce electrical contacting of the sheet shield 55 or 57. If the locking spring 35 is not to be used for spring-actuated engagement on a shielding sheet, but rather on the insulation material 15 of ribbon cable configuration 67, or on one of the insulation sheaths 51 or 53, the locking spring 35 can consist of a resilient non-conductive material.

Figure 7:
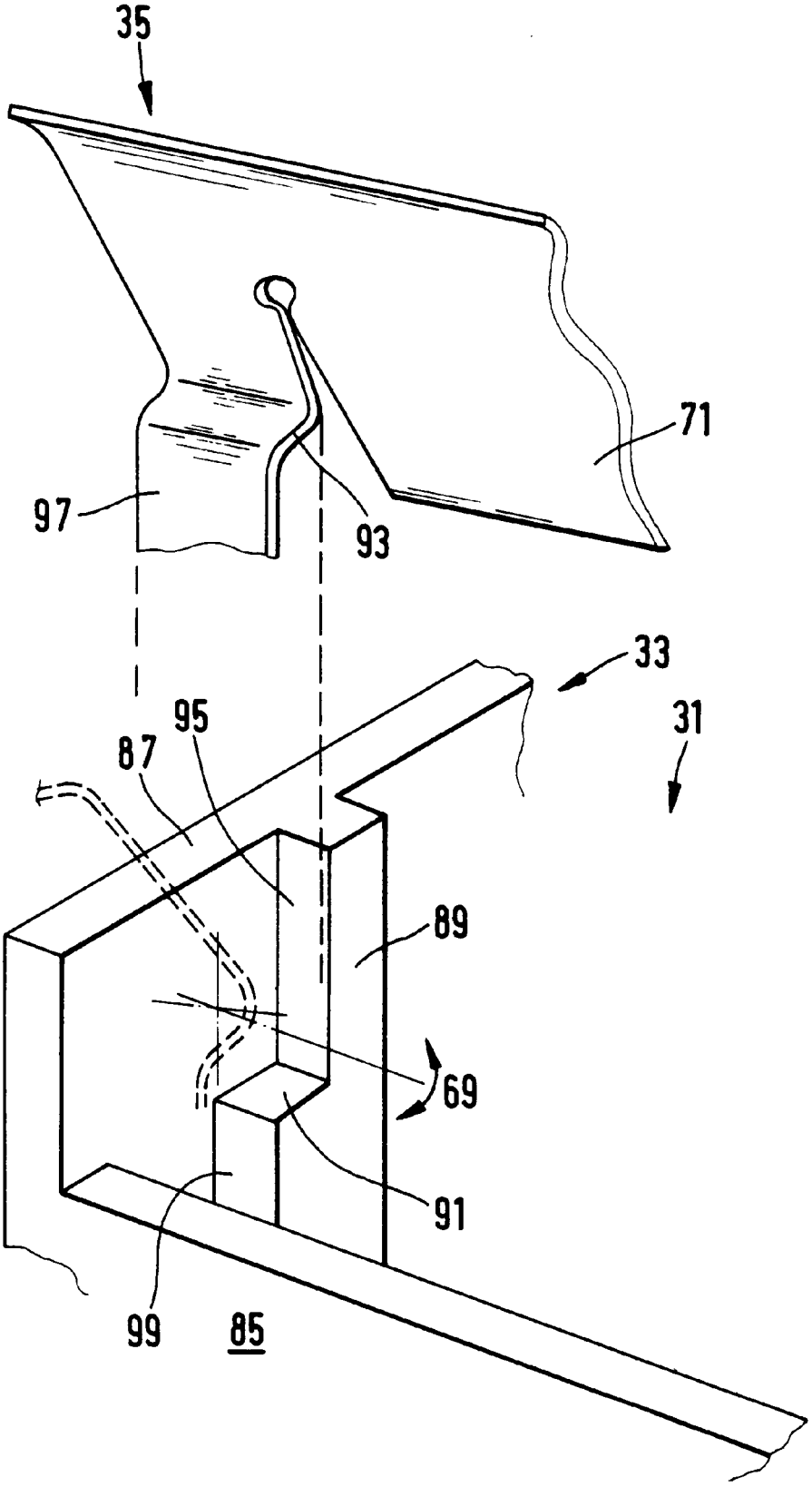
FIG. 7 shows a partial detailed view of the embodiment depicted in FIG. 1 of a locking spring device and locking spring housing.

A pivotable support of locking spring 35 within additional housing 33 is further explained with reference to FIG. 7. The additional housing 33 serves as a locking spring housing at top 83, on the cable plug-in side, and on the upper end of its rear wall 85. A support post 89, with a support shoulder 91 displaced downward in one piece from top 83, is situated on the inside of two transverse side walls 87 of the additional housing. One or two convex support arcs 93 are formed on both sides of the locking region 71 of locking spring 35. The convexity of each support arc 93 facing locking region 71 is also supported on one of the two support shoulders 91 and on the wall region of the corresponding support post 89 situated above the support shoulder 91 in pivotable fashion.

In the variant of locking spring 35 depicted in FIGS. 1 and 2, the locking region 71 is cut out from the plate of locking spring 35. The plate remainders 97, left after cutting on both sides of locking region 71, extend into an intermediate space between the rear wall 85 and the corresponding support post 89. The locking spring 35, on its upper end in FIG. 2, has an upper edge 101 bent away from the locking region 71.

The locking spring 35, on the lower edge in FIG. 2, is provided with two protrusions 103 that can be plugged into correspondingly shaped printed circuit board holes and electrically connected there to ground conductors.

Figure 6:
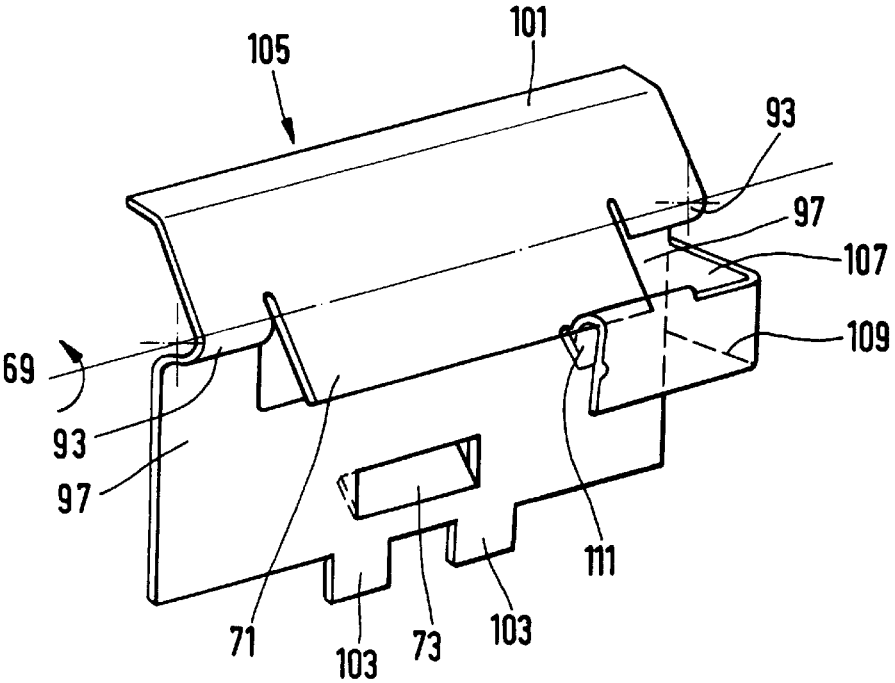
FIG. 6 shows a variant of a locking spring device according to the present invention.

The locking spring 35 is employed to contact the upper shielding sheet 55 or the lower shielding sheet 57, depending on the rotational position in which the ribbon cable is plugged into the cable plug-through opening 31. The locking spring 35 is suitable, in particular, for shielding sheet contacting of the ribbon cable configuration 49 depicted in FIG. 3. When the ribbon cable configuration 61 depicted in FIG. 4 is used, electrical contacting of both the upper shielding sheet 55 and the lower shielding sheet 57 is prescribed. For this type of two-sided contacting, a locking spring 105, as shown in FIG. 6, is suitable. This has the same design as the locking spring depicted in FIG. 2 with regards to the locking region 71, the support arc 93, the plate remainder 97, the locking tab 73, the upper edge 101 and the protrusions 103. In addition to the locking spring 35 depicted in FIG. 2, the locking spring 105 depicted in FIG. 6 has an angle bridge 107 that protrudes at right angles from the plate remainder 97 and has an additional locking region 111 on its angled free end 109. When a ribbon cable, with a ribbon cable configuration 61 depicted in FIG. 4, is plugged into the cable plug-through opening 31 of additional housing 33, it is guided between the oblique locking regions 71 and 111 until it has reached its final plug-in position. The additional locking region 111 may also be directed obliquely to locking region 71. This would result in stronger attachment of the ribbon cable, but may hamper release of the ribbon cable from locking.

When a ribbon cable configuration is used in which only one shielding sheet or no shielding sheet must be contacted, the locking spring 105, according to FIG. 6, can also be advantageous. In this case an easily definable plug-through gap between locking region 71 and 111 is formed for the ribbon cable by the locking spring 105 so that the ribbon cable can be fastened particularly well during use of locking spring 105.

Figure 8:
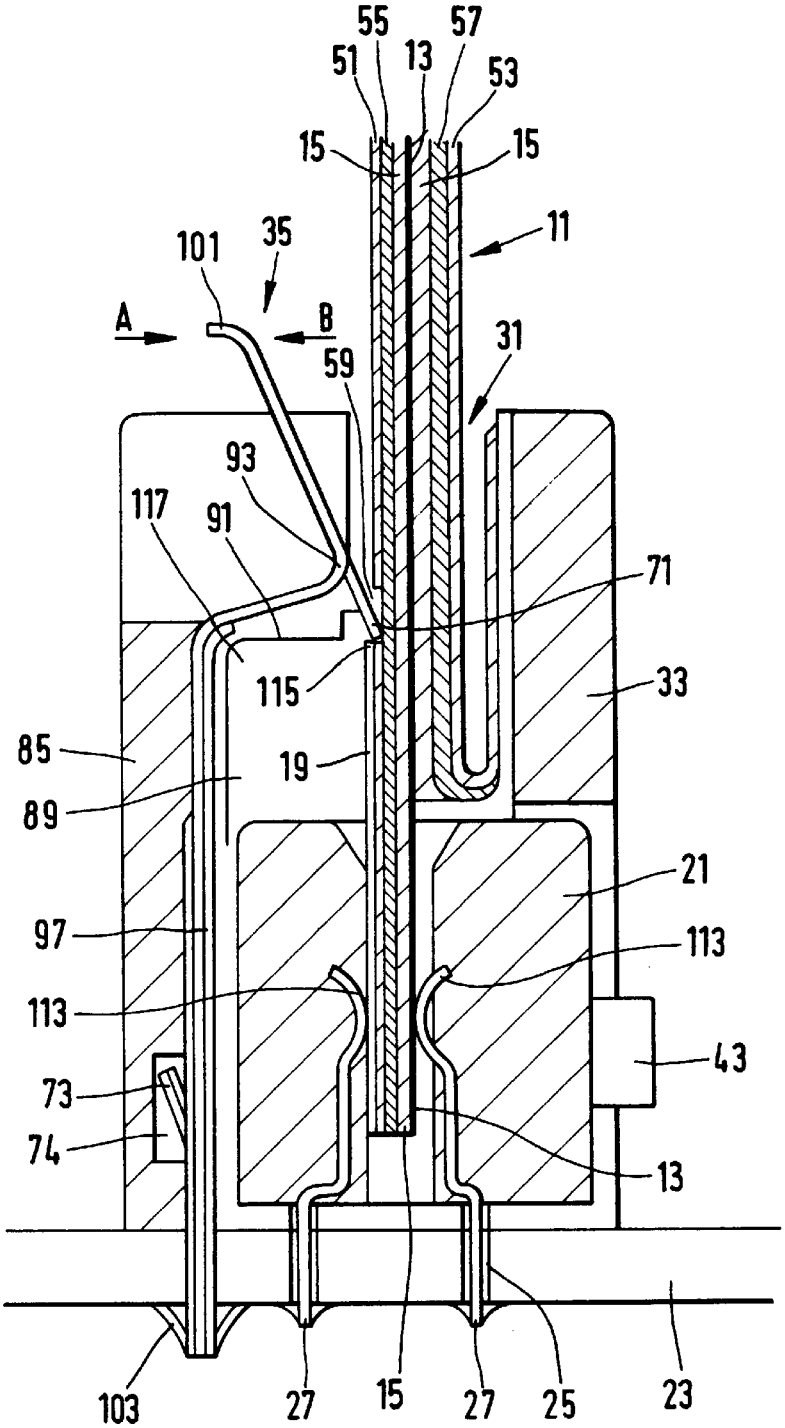
FIG. 8 shows a cross section of a plug-in connector according to the present invention.
Figure 9:
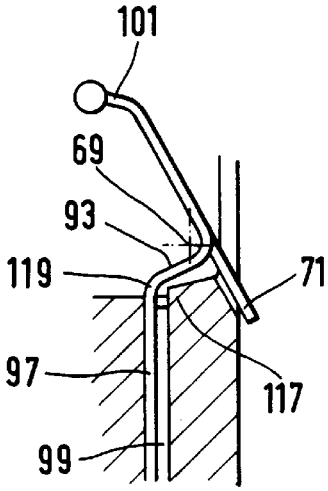
FIG. 9 shows a detailed view of the plug-in connector depicted in FIG. 8.

The positioning and method of operation of the locking spring 35 are shown in FIGS. 8 and 9. In the cutaway view of FIG. 8, the plug-in connector 21 is shown in the inserted position in the plug-in opening 37 of the additional housing 33. The cutaway view shows conductor contacts 113 with connection posts 27, which are soldered into the solder holes 25 of the printed circuit board 23. A ribbon cable end is inserted into the cable plug-through opening 31 of additional housing 33 and the cable plug-in opening 29 of plug-in connector 21. The flat conductors 13, as in FIG. 13, are exposed on at least one side so that they can be electrically contacted by at least one conductor contact of the conductor contact pair 113. Ordinarily the flat conductors 13 are only exposed on one side so that only one conductor contact 13 of the oppositely lying conductor contact pair produces electrical contact with the corresponding flat conductor 13, whereas the other conductor contact 113 of the corresponding contact conductor pair exerts only a counterpressure. In the depiction of FIG. 8, the ribbon cable end has a reinforcement sheet 19 on the side facing locking spring 35. The upper end 115 of reinforcement sheet 19 forms an engagement shoulder for the free end of locking region 71. If the ribbon cable has shielding sheets that are to be electrically contacted by means of locking spring 35, the insulation sheath 55 or 57 facing the locking spring 35 is provided with a locking recess 59, 63 or 65 so that the free end of the locking region 71 can make electrical contact with this shielding sheet. In this case the locking spring 35 consists of metal or another electrically conducting material and at least one of the protrusions 103 is connected to a ground conductor of the printed circuit board 23. In this fashion the shielding sheet is electrically connected to the ground conductor of the printed circuit board 23 via the locking spring 35.

The plate part of locking spring 35, situated next to and below locking region 71, is arranged between the support post 89 and the rear wall 85 of the additional housing 33 with limited play between the support post 89 and the rear wall 85 so that the locking spring 35 is held between the locking tab 73 in a complementary locking shoulder 74 of rear wall 85. The locking spring 35 remains locked in additional housing 33. As is in FIG. 9, a front edge 117 of support shoulder 91 forms a stop for the lower end 119 of support arc 93 of locking spring 35. The center of curvature of the support arc 93 then forms the pivot axis 69 of locking spring 35. In the resting state of locking spring 35 its locking part 71 is prestressed on the ribbon cable so that locking of the free end of the locking region 71 with the ribbon cable occurs in shape-mated fashion.

The locking spring 35 forms a free-wheeling mechanism with its locking region 71 so that, when the ribbon cable is inserted into the cable plug-through opening 31, the locking region 71 expands elastically and does not prevent insertion of the ribbon cable, whereas withdrawal of the ribbon cable from the cable plug-through opening 31 initiates locking between the locking region 71 and the shoulder, which is formed by the upper reinforcement sheet end 115 and/or the limitation of the locking recess 59, 63 or 65. If locking between the ribbon cable and locking region 71 is to be released, pressure is exerted with the finger or a tool against the upper edge 101 of the locking spring 35 in the direction of arrow "A" shown in FIG. 8 so that pivoting of the angular region 71 around the pivot axis 69 releases the ribbon cable. Release of locking between the ribbon cable and the locking region 71 can also occur by moving the upper edge 101 of the locking spring 35 in the direction of arrow "B" depicted in FIG. 8 so far from the ribbon cable that the locking region 71 disengages from the ribbon cable. The ribbon cable can then be easily removed from the cable plug-in opening 29 and the cable plug-through opening 31.

Figure 10:
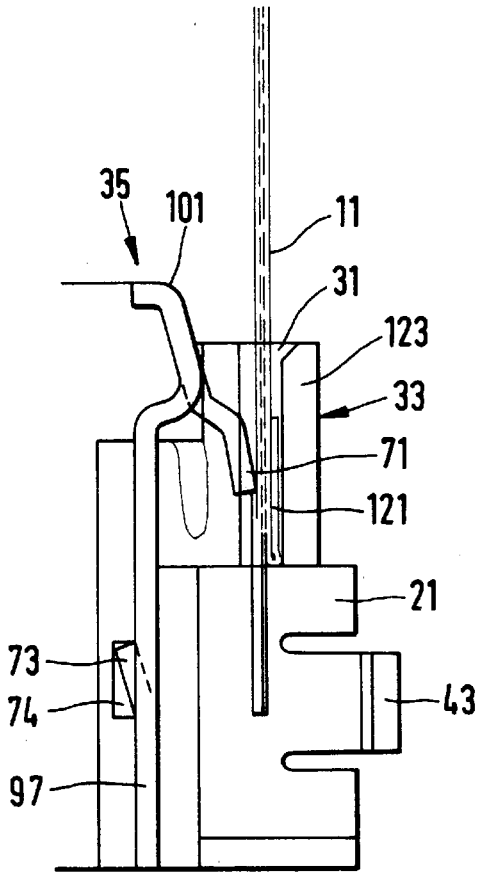
FIG. 10 is a schematic side view of the plug-in connector depicted in FIG. 8.
Figure 11:
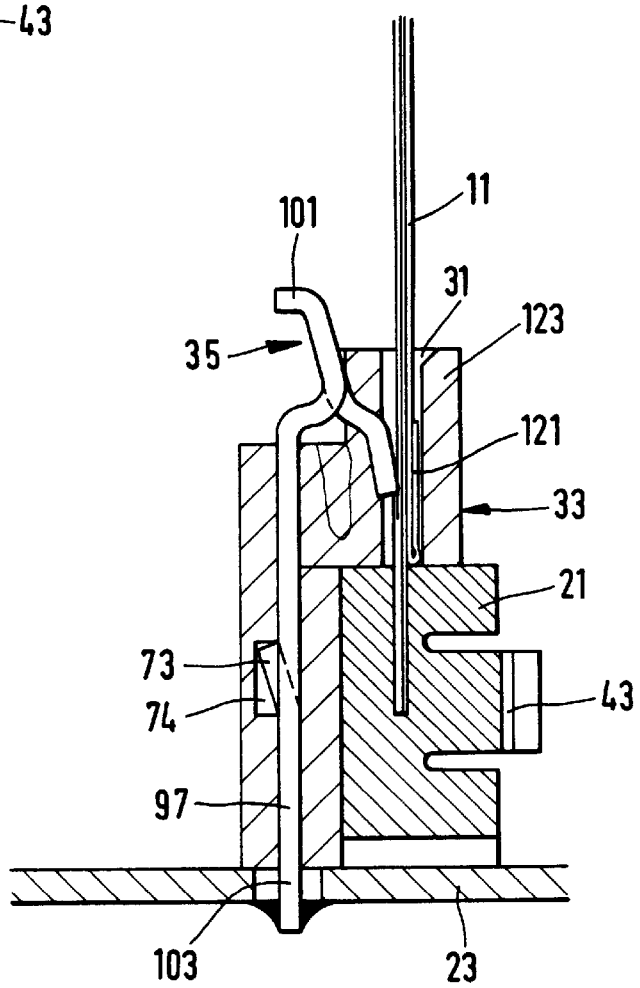
FIG. 11 is a side view of the plug-in connector depicted in FIG. 10 with a printed circuit board.

Views similar to FIG. 8 are shown in FIGS. 10 and 11. In the embodiments depicted in FIGS. 10 and 11, the insulation material 15 is not cut on the lower ribbon cable end where the flat conductors 13 are exposed, but instead is turned upward in the form of a wrapping 121 and acts there as a support on the inside of a front wall 123 of additional housing 33. The wrapping 121 supports reliable positioning of the ribbon cable for reliable engagement between the locking region 71 and the locking recess 59, 63 or 65, and optionally the upper reinforcement sheet end 115.

Figure 12:
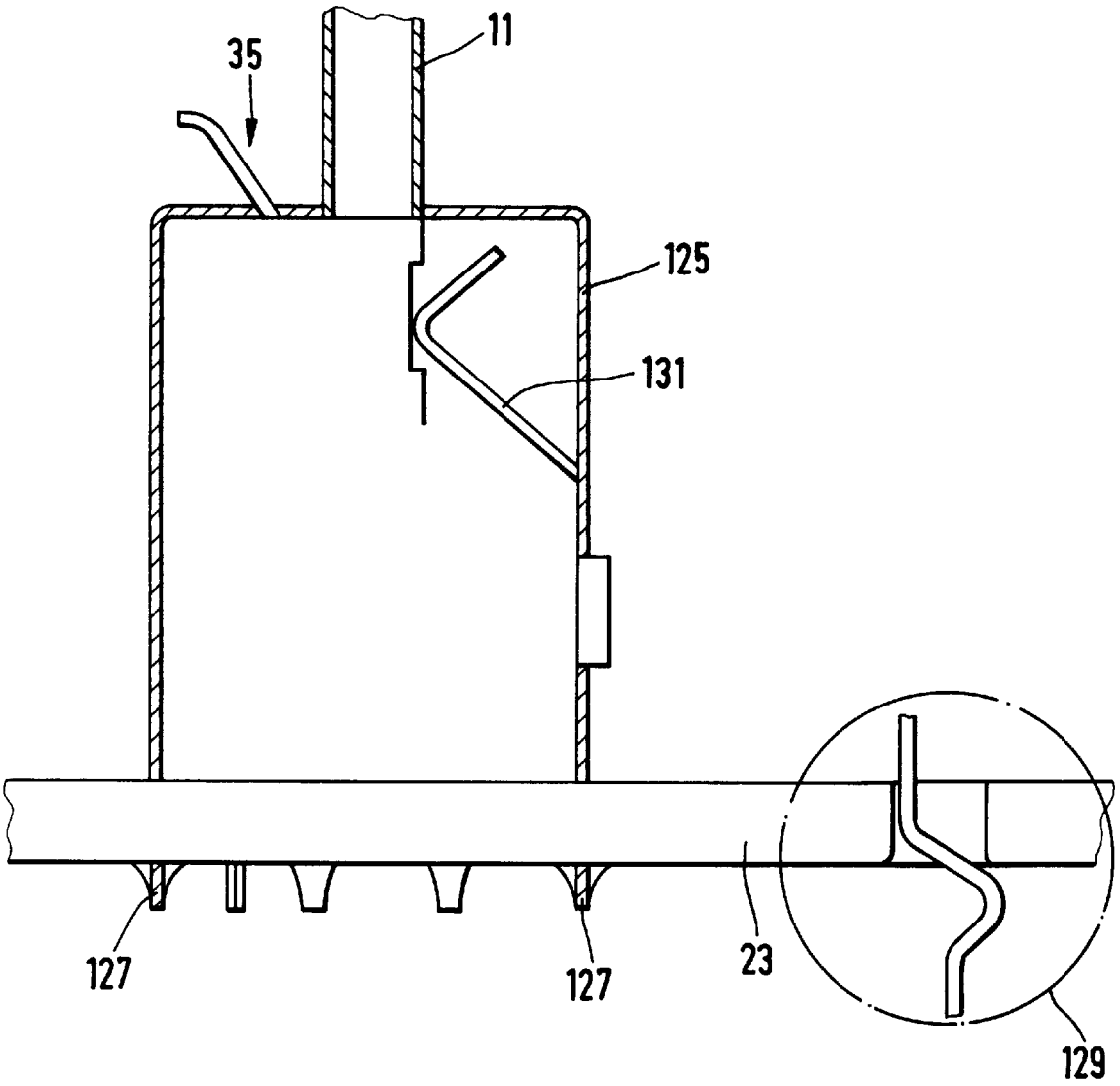
FIG. 12 shows a variant of a plug-in connector according to the invention with shielding housing.

FIG. 12 shows an embodiment in which the arrangement of plug-in connector 21, additional housing 33, locking spring 35 and the ribbon cable end is accommodated within a shielding housing made of an electrically conducting material. This is connected by means of lower protrusions 127 to ground conductors (not shown) of a printed circuit board 23, either by soldering or by a solder-free clamp connection, as shown in region 129 of the printed circuit board. The shielded housing 125 is provided with an additional locking spring 131 that can be cut and bent out from a side wall of the shielded housing 125. The locking spring 35, only partially visible in FIG. 12, can be used for contact of a shielding sheet 55 or 57, while the additional locking spring 131 can assume contacting of the other shielding sheet 57 or 55 of the ribbon cable configuration 61 in FIG. 4.

If a ribbon cable configuration 61 is used, that is a configuration having two shielding sheets 55, 57 that are not connected to each other electrically via one of the flat conductors 13, electrical contacting of both shielding sheets 55, 57 by means of an electrically conducting locking spring is recommended, for example, by means of the two locking regions 71 and 111 of the locking spring 105 depicted in FIG. 6, or by means of the two locking springs 35 and 131 depicted in FIG. 12. Since in this type of ribbon cable configuration only one of the two shielding sheets would be connected by means of a locking spring during one-sided electrical contacting, as shown in FIG. 8, an additional wire will be required as before for electrical contacting of the other shielding sheet.

Ribbon cables of the considered type have very thin thicknesses, for example, of only about 0.4 mm. This means that the shielding sheets 55,57 are also very thin and can break, especially on contact with locking region 71. This problem is solved by the embodiments of the invention depicted in FIGS. 15 to 19.

Figure 15:
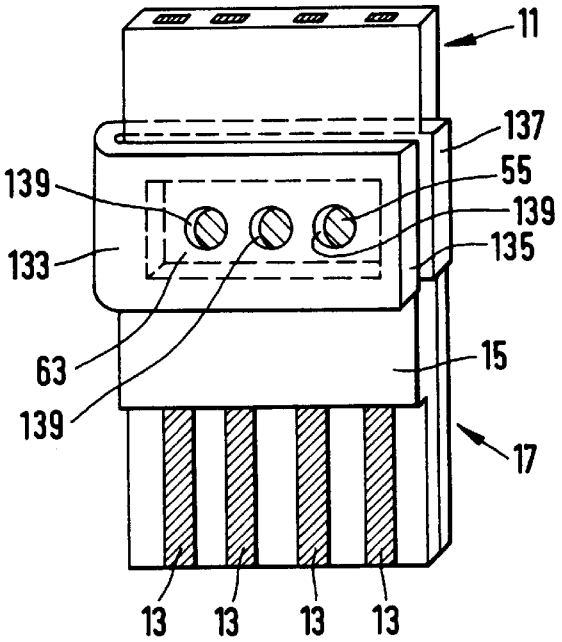
FIG. 15 shows a schematic view of a ribbon cable suitable for use with the present invention.

In the embodiment depicted in FIG. 15, when the ribbon cable configuration 49 depicted in FIG. 3 is used, the locking recess 59 is protected with a reinforcing cover 133. When the ribbon cable configuration 61 depicted in FIG. 4 is used, the upper locking recess 63 and the lower locking recess 65 are protected with a reinforcing cover. The reinforcing cover 133 consists of a plastic strip folded around a long edge of the ribbon cable 11 forming arms 135 and 137, both of which lie on different flat sides of ribbon cable 11 so that they cover the locking recesses 59, or 63 and 65. In the regions lying above the locking recesses 59, or 63 and 65, the arms 135 and 137 are provided with penetration openings 139. Penetration protrusions 141 on locking regions 71 of the modification of locking spring 35 (depicted in FIG. 18) pass through the penetration openings 139 when the ribbon cable 11 is situated in the locking position in locking spring housing 33. In this embodiment, with appropriate relative dimensioning of the penetration openings 139 and penetration protrusions 141, the engagement force of the locking region 71 is essentially taken up by the cover 133 so that the shielding sheets 55, 57 remain essentially unloaded and the hazard of their breaking is reduced very sharply.

Alternatively, the cover 133 can be made from two individual plates, one of which is arranged on one flat side and the other on the opposite flat side of ribbon cable 11. In contrast to the embodiment depicted in FIGS. 15 and 17, the two arms 135 and 137 are not joined together in one piece, but represent separate parts.

Figure 16:
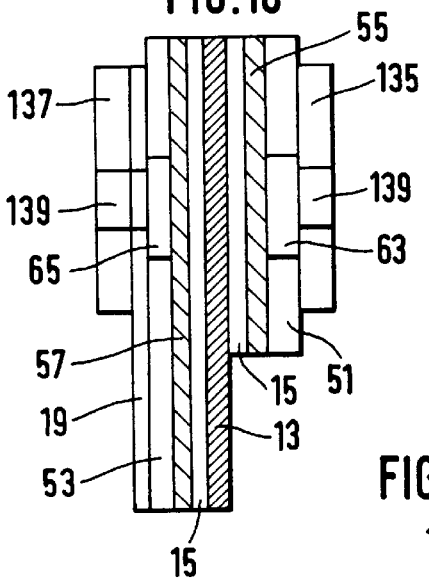
FIG. 16 shows a schematic side view of the embodiment depicted in FIG. 15.
Figure 17:
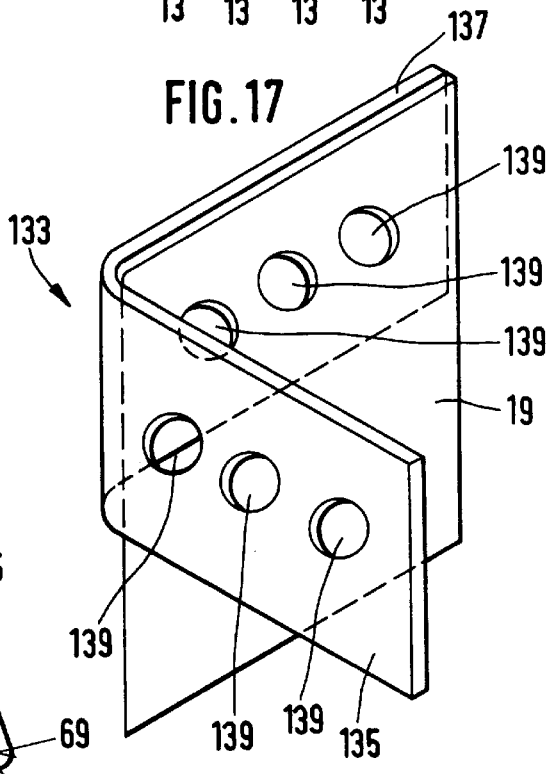
FIG. 17 shows an example of a covering suitable for use in the embodiment according to FIGS. 15 and 16.
Figure 18:
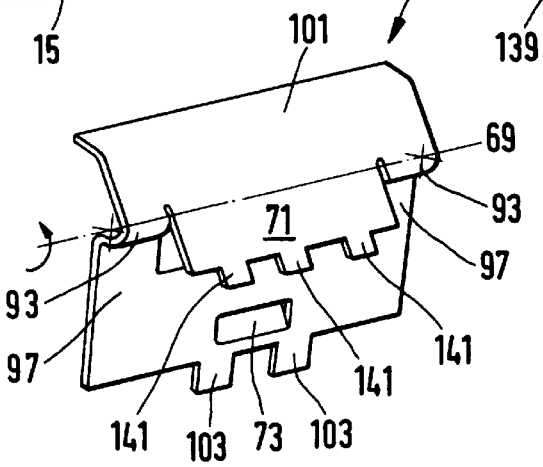
FIG. 18 shows a locking spring suitable for use in the embodiment of FIGS. 15 to 18.

FIG. 16 shows a cross section with a cover 133 either of the one-piece, folded embodiment depicted in FIG. 15, or of the embodiment with two separate arms 135 and 137.

If the ribbon cable 11 is to be reinforced, as shown in FIGS. 8 and 13, a reinforcement sheet 19 can be applied to the arm of the cover 133 that is situated on the side whose flat conductors 13 are not exposed in the end region 17 of ribbon cable 11. The reinforcement sheet 19 is then situated on the inside of arm 137 facing the ribbon cable. The reinforcement sheet can be designed either in one piece with cover 133, or as a separate reinforcement sheet that is adhered to the inside of arm 137. In the latter instance, the penetration openings 139 of arm 137 are punched through the reinforcement sheet 19.

In the embodiments with a cover 133, the corresponding shielding sheet or shielding sheets can be exposed over the entire width of the ribbon cable and covered with cover 133 instead of the locking recesses 59, or 63 and 65.

Both reinforcement of ribbon cable 11 in its region weakened by locking recesses 59, 63, 65 and protection of the shielding sheets 55, 57 can be achieved with cover 133.

Figure 19:
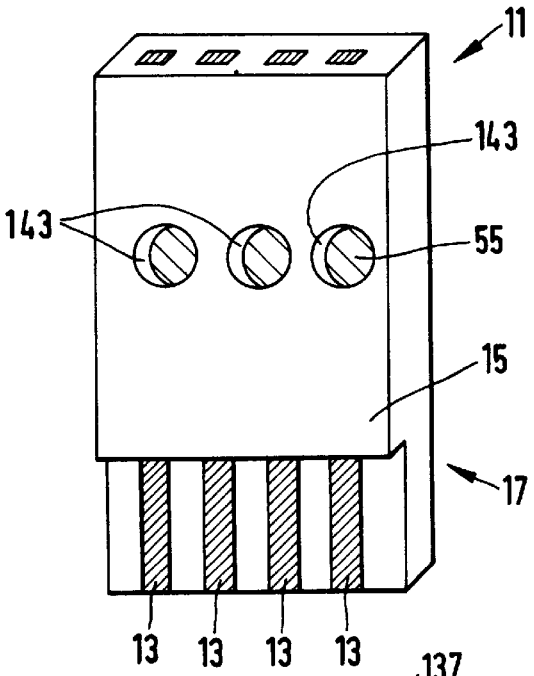
FIG. 19 shows a schematic view of another embodiment of a ribbon cable suitable for use with the present invention and applicable together with the locking spring depicted in FIG. 18.

In the embodiment depicted in FIG. 19, no reinforcing cover 133 is provided, but penetration openings 143 are provided in insulation sheath 51 and/or 53 instead of the locking recesses 59, or 63 and 65. In this case the penetration protrusions 141 penetrate directly through the penetration openings 143 in the insulation sheath of ribbon cable 11 to the shielding sheet 55 and/or 57 on the locking region 71 of the locking spring 35 depicted in FIG. 18. In this case, the relative dimensions of the penetration openings 143 and the penetration protrusions 141 are chosen so that the engagement force of the locking region 71 is taken up by the region of the insulation sheath 51 and/or 53 surrounding the penetration openings 143.

Although a few exemplary embodiments of the present invention have been described in detail above, those skilled in the art readily appreciate that many modifications are possible without materially departing from the novel teachings and advantages which are described herein. Accordingly, all such modifications are intended to be included within the scope of the present invention, as defined by the following claims.

What is claimed is:

1. An electrical ribbon cable connector system comprising:

a ribbon cable having at least one ribbon cable conductor having a first side, a second side and an end;

an insulation material being disposed about said at least one ribbon cable conductor, said first side being exposed at said conductor end through at least one locking recess defined in said insulation material;

at least one conductor contact;

a ribbon cable plug-in connector having:

a plug-in connector housing defining a cable plug-in opening adapted to accept said ribbon cable end and having at least one conductor contact adapted to electrically contact said at least one ribbon cable conductor though said at least one locking recess;

a locking spring housing defining a plug-through opening and being disposable about said plug-in connector housing to align said plug-through opening and said cable plug-in opening; and a locking spring device having at least one locking region that engages said at least one locking recess of the ribbon cable under spring tension for blocking action relative to withdrawal of said end of said ribbon cable from said cable plug-through opening when the ribbon cable is inserted into said plug-through opening, said locking spring device being arranged in said locking spring housing.

2. The ribbon cable connector system of claim 1, wherein said locking spring housing is adapted to connect to said plug-in connector housing.

3. The ribbon cable connector system of claim 2, wherein said locking spring housing is adapted to lock said ribbon cable in said plug-in connector housing.

4. The ribbon cable connector system of claim 1, wherein said locking region releasably engages the ribbon cable.

5. The ribbon cable connector system of claim 1, wherein said locking region engages said first side of said ribbon cable conductor.

6. The ribbon cable connector system of claim 1, wherein the at least one locking region is extended obliquely from said locking spring device to said plug-in connector housing.

7. The ribbon cable connector system of claim 1, wherein said locking spring housing defines a pivot axis that runs parallel to the transverse direction of a ribbon cable inserted into said cable plug-in opening of said connector housing, and wherein said locking spring device can be pivoted relative to the plug-in connector housing around said pivot axis, wherein said locking spring device is supported on said locking spring housing so that said locking spring device is elastically stressed in the pivot rest position against a ribbon cable inserted into said cable plug-through opening, and wherein said locking spring device can be pivoted against its spring stress so that it is out of locking engagement with a ribbon cable inserted into said cable plug-through opening.

8. The ribbon cable connector system of claim 1, wherein said locking spring device has a locking spring clamping means to attach said locking spring device to said locking spring housing, and wherein said locking spring housing has a receptor adapted to attach said locking spring clamping means.

9. The ribbon cable connector system of claim 2, wherein said locking spring housing has a plug-in connector opening opposite said plug-through opening in which the plug-in connector housing can be accepted to align the cable plug-in opening of the plug-in connector housing with said plug-through opening of the locking spring housing.

10. The ribbon cable connector system of claim 9, wherein said locking spring housing further comprises at least one elastic locking spring arm having a locking shoulder on the end arranged on a side of said plug-in connector opening, and wherein said locking shoulder of said at least one elastic locking spring arm engages said plug-in connector housing when said plug-in connector housing is inserted into the locking spring housing to align said plug-in opening with said cable plug-through opening of the locking spring housing.

* * * * *